US005452937A

United States Patent [19]

Piretti

[11] Patent Number: 5,452,937

[45] Date of Patent: Sep. 26, 1995

[54] PLATE FOR CONNECTING THE SEAT, BACK AND LEGS, ESPECIALLY FOR CHAIRS

[75] Inventor: Giancarlo Piretti, Bologna, Italy

[73] Assignee: PRO-CORD s.r.l., Italy

[21] Appl. No.: 308,832

[22] Filed: Sep. 19, 1994

Related U.S. Application Data

[63] Continuation of Ser. No. 26,490, Mar. 4, 1993, abandoned.

[30] Foreign Application Priority Data

Mar. 9, 1992 [IT] Italy ..... BO92U0035

[51] Int. Cl.[6] ..... A47C 3/00

[52] U.S. Cl. ..... 297/301.4; 297/301.5

[58] Field of Search ..... 297/300, 304, 297/306, 291, 354.1, 378.1, 440.1, 451

[56] References Cited

U.S. PATENT DOCUMENTS

| | | | |
|---|---|---|---|
| 860,632 | 7/1907 | Breithut | 297/354.1 X |
| 2,570,177 | 10/1951 | Wood | 297/306 |
| 2,680,474 | 6/1954 | Fritz | 297/306 |
| 3,057,661 | 10/1962 | Moxley | 297/378.1 X |
| 3,133,763 | 5/1964 | Stoll et al. | 297/304 |
| 3,183,036 | 5/1965 | Hill | 297/440.1 X |
| 3,601,444 | 8/1971 | Doerner | 297/300 |
| 3,712,672 | 1/1973 | De Graaf | 297/306 |
| 3,989,297 | 11/1976 | Kerstholt | 297/306 X |
| 4,561,693 | 12/1985 | Brownlie et al. | 297/306 |
| 4,938,532 | 7/1990 | Burgess | 297/291 X |

FOREIGN PATENT DOCUMENTS

| | | | |
|---|---|---|---|
| 0533882 | 9/1931 | Germany | 297/304 |

*Primary Examiner*—Kenneth J. Dorner
*Assistant Examiner*—Milton Nelson, Jr.
*Attorney, Agent, or Firm*—Andrus, Sceales, Starke & Sawall

[57] ABSTRACT

A chair assembly consists of a seat, a back, one or more leg members and a mounting plate. The seat, back and leg members are removably mounted to the mounting plate, for allowing such components to be removed and replaced as desired. The back includes a mounting arm, the end of which is pivotably connected to the mounting plate. A spring is interposed between the mounting arm and the plate, for biasing the back to an upright position. Each leg member includes an upper mounting portion, mounted to the plate by threaded fasteners such as screws or the like. The plate includes an upper surface which engages a lower surface defined by the seat. Threaded fasteners are employed to mount the seat to the mounting plate. The major components of the chair are thus removably mounted to the mounting plate, for providing modular assembly and facilitating ease in replacing some or all of the components of the chair.

13 Claims, 2 Drawing Sheets

FIG. 1
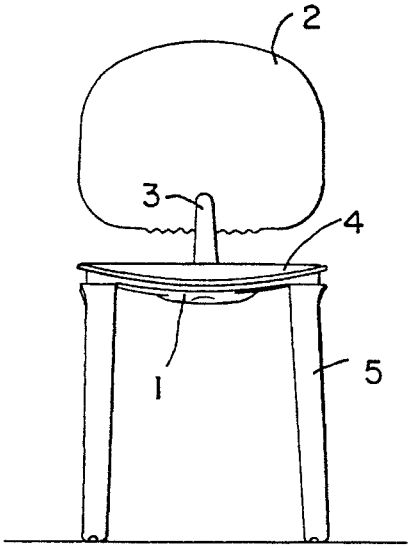
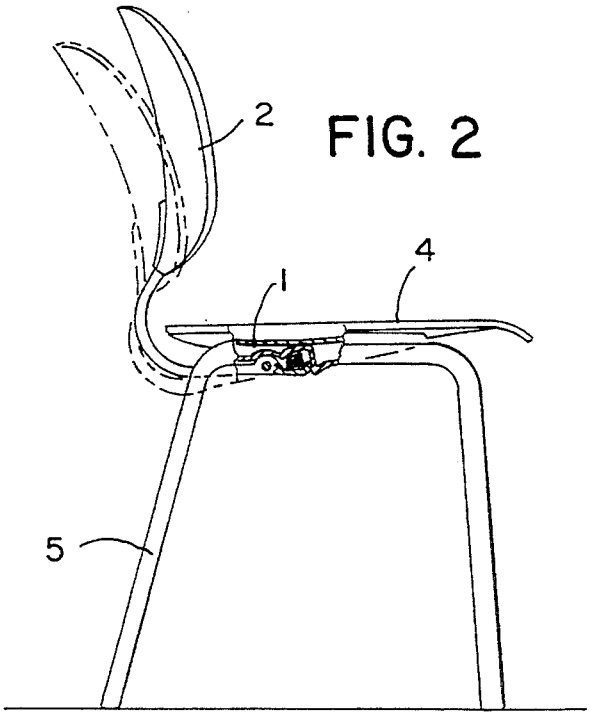
FIG. 2
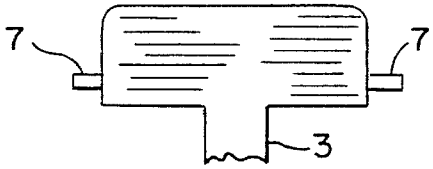
FIG. 3a
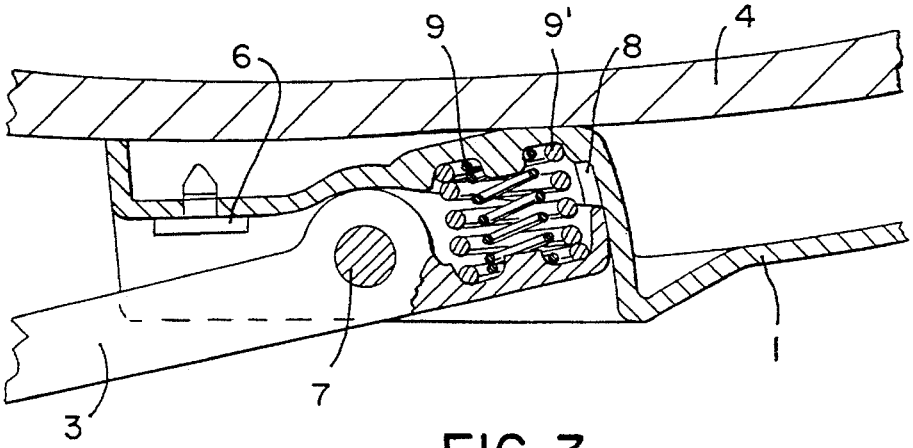
FIG. 3

PLATE FOR CONNECTING THE SEAT, BACK AND LEGS, ESPECIALLY FOR CHAIRS

This application is a continuation of application Ser. No. 08/026,490, filed Mar. 4, 1993, now abandoned.

This invention refers to a plate connecting the component parts of a chair (seat, back and legs) designed to make up the structure with great ease and replace its component parts. It is known that a normal chair consists of a back, a horizontal surface (with or without recesses) or seat and three or four legs or feet, joined together, or not, by cross members. Each chair has its own structure which does not permit variations of the original design. In general this is a single body that does not allow any alteration to the original shape and dimensions.

It is also known that there exist systems to tilt the back of the chair, based on joints which, in many cases, at the same time cause the seat-surface to lift when the back is in its reclining, relaxed position, and one or more compressed counteracting springs which facilitate and accompany the return of the back to the upright position.

Other known systems entail the tilting forward and back, up and down, of the whole seat-back body, again using the elastic property of compensating springs which permit a gradual and adjustable movement.

The use of supports of this type which rock the chair-back forwards and back have long been known. The aim of this invention is to permit the creation of a chair which extends the capabilities of the basic model, allowing different configurations and characteristics of its component parts.

BACKGROUND AND SUMMARY

Another purpose is for a plate in suitable material (aluminium, plastic or some other) to connect and support the structural elements of the chair so as to allow it to be replaced, as and when desired.

These and other aims, which will become apparent below, are achieved by the connection plate, the subject of this invention, which is characterised by the fact that a single configuration of the plate permits the connection and interchangeability of parts such as the legs, the back with its support and the seat of the chair.

The seat is fitted to the plate by means of screws which, by engaging with others, allow the legs to be fastened to the body.

The legs can be changed very easily with legs of different shape, material and size simply by tightening/loosening the fastening screws while keeping, if required, the same seat and the same back.

The connecting plate houses the fulcrum of the pin joint, with a counter-spring which permits the rotation (under pressure) of the integral back support so as to recline the back into the relaxed position.

The bottom edge of the back is grooved to provide a purchase or grip for the fingers when lifting and moving the chair.

BRIEF DESCRIPTION OF THE DRAWINGS

Other characteristics and advantages will become apparent from the following description and the attached drawings which illustrate, in schematic form and by way of example, one way to realise the invention. With reference to these drawings:

FIG. 1 is a front view of the chair;

FIG. 2 is a side view of the chair with a portion broken away;

FIG. 3 is a detail of the broken away portion of FIG. 2 showing the connection and rotating system for tilting the back support in relation to the plate;

FIG. 3A is a bottom plan view of a portion of the back support.

DETAILED DESCRIPTION

Figure 4:
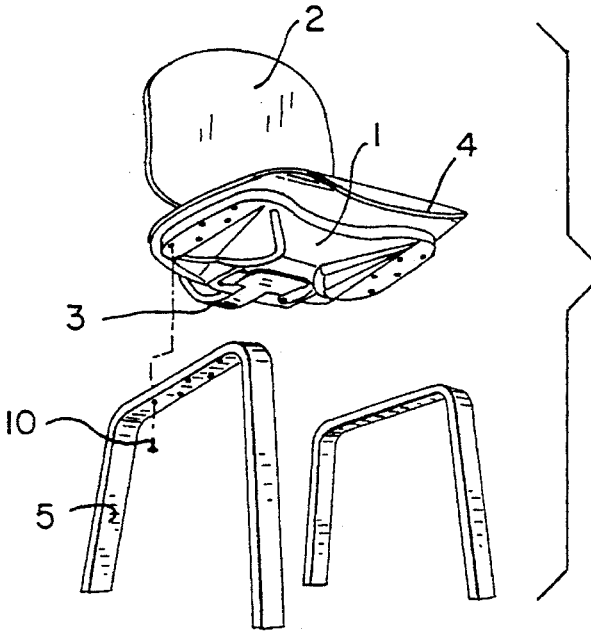
FIG. 4 is a exploded isometric view, from the bottom, of the chair with the plate and the connection of one type of leg.

The connecting plate 1 bears the seat 4, to which it is secured with connecting screws, and the back support arm 3 with the connection described below which, keyed and fastened with screws, bears the back 2.

The legs 5 are fastened with the screws 10 or 12 to the plate 1 and, although they are shown with a rectangular section, any type of section and material (for example tubular steel) can be used instead.

The jointed connection between back support and plate is based on the shape of the said back support 3 with two lateral plate 7 and the connecting plate which bears a recess for each part in which the supports of the pins 7 with their bushings are housed and secured to the plate 1 with screws.

The pins 7 of the support 3 rotate with the support in relation to the plate and the limits of this rotation correspond to the extent of inclination of the back, illustrated in FIG. 2; the said limits are defined on one side by the strike pin 6 for forward rotation and on the other by the striker 8, in the plate, for tilting backwards.

Figure 5:
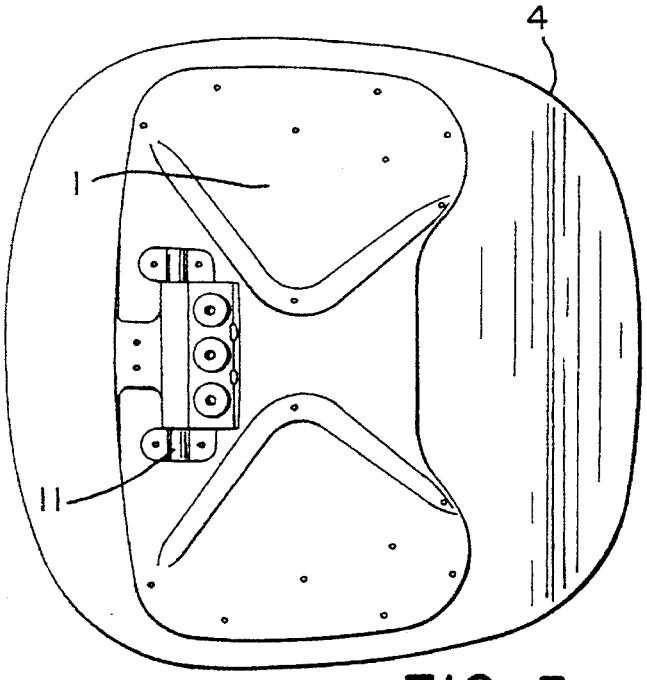
FIG. 5 is a view from below of the plate illustrating several details of its shape.
Figure 5A:
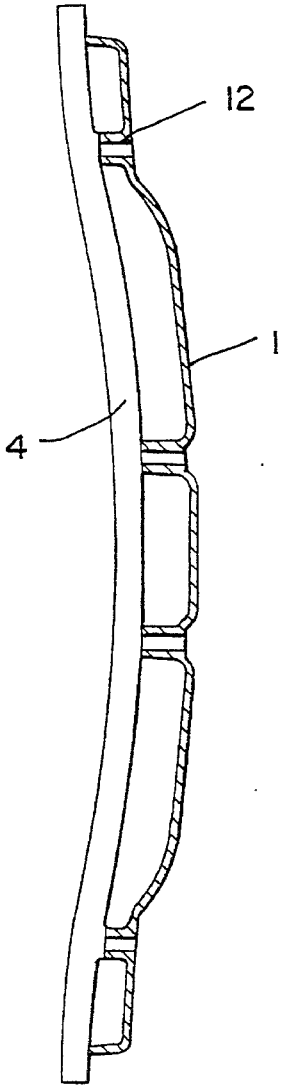
FIGS. 5A and 5B are, respectively, longitudinal and cross sections of the said plate.
Figure 5B:
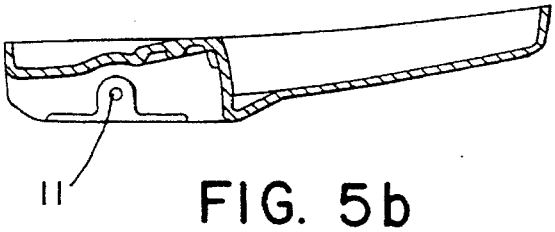

The two spiral compression springs 9, 9' which, when compressed, oppose the backward rotation of the back and therefore the downward movement of the support arm 3, return the back of the chair to its normal position when the pressure of the person seated on the chair is removed. The schematic drawings in FIGS. 5, 5A and 5B illustrate the plate body with the outline of the seat 4.

The seatings 11 house the above-mentioned supports of the connecting and roller pins (fulcrum) of the reclining back support.

The plate 1 is shell-shaped with flat surfaces for fitting the legs and upper ribs to support the seat which is fastened with screws to the threaded seatings, as in 12.

This invention achieves the purposes set by means of a single block connecting plate to which the component parts of the structure, which may be of different shape, design characteristics and materials, can easily be fitted with screws, so as to create a chair fitted with a particularly simple and compact seat-legs-back system, without the problems and complexity of various technical solutions currently employed.

This invention, illustrated and described by way of example, may be extended to all those accessory variations which, as such, fall within its scope.

I claim:

1. A chair, comprising:

a seat defining an upper surface and a lower surface and extending along a longitudinal axis;

a back defining a forward surface and a rearward surface and extending along a longitudinal axis;

a mounting arm defining a first upright portion connected to the back along the longitudinal axis of the back and a second portion extending forwardly from the first portion;

a pair of leg members, each leg member including an upper leg mounting portion and forward and rearward legs depending therefrom; and a mounting plate;

wherein the mounting plate defines an upper surface and the seat is mounted to the mounting plate such that the seat lower surface is engaged with the mounting plate upper surface, and wherein the second portion of the mounting arm is pivotably mounted to the mounting plate along the longitudinal axis of the seat for pivotably interconnecting the back with the mounting plate, and wherein the upper leg mounting portion of each leg member is mounted to the mounting plate on either side of the second portion of the mounting arm for interconnecting each leg member with the mounting plate, whereby a chair assembly is constructed in which the seat, the back and the leg members are mounted to the mounting plate, wherein the mounting plate comprises a shell structure having a peripheral outer edge defining the upper surface, and wherein the seat is mounted to the mounting plate via a plurality of threaded fasteners extending therebetween.

2. The chair of claim 1, wherein the upper leg mounting portion of each leg member extends in a front-to-back direction relative to the chair assembly.

3. In a chair having a seat and a back, the improvement comprising:

a plate to which the seat is mounted;

an arm including an upright portion to which the back is mounted, wherein the arm further includes a forwardly extending lower portion pivotably mounted to the plate for mounting the back to the seat for pivoting movement about a horizontal pivot axis; and stop structure interposed between the plate and the arm for controlling the range of pivoting movement of the back relative to the seat, the stop structure comprising forward and rearward downwardly facing stop surfaces provided on the plate located one on either side of the pivot axis and engageable by the arm lower portion, wherein the plate includes a recess within which the forward end of the arm lower portion is received and within which the forward and rearward stop surfaces are located, wherein the rearward stop surface is defined by a strike pin mounted to the plate and disposed within the recess.

4. The chair of claim 3, wherein the arm lower portion is pivotably mounted to the plate by means of a pair of pins extending transversely from the arm lower portion and pivotably mounted to the plate adjacent the recess.

5. The chair of claim 3, wherein the forward stop surface is defined by a strike surface formed in the plate.

6. The chair of claim 5, further comprising a spring interposed between the arm lower portion and the plate, wherein the spring is located between the pivot axis and the strike surface.

7. In a chair having a seat and a back, the improvement comprising:

a plate to which the seat is mounted, wherein the plate includes a lower wall and a peripheral outer wall extending upwardly from the lower wall, the outer wall terminating in an upper edge, wherein the seat is mounted to the plate such that a lower surface defined by the seat engages the upper edge of the peripheral outer wall, and wherein the lower wall is formed so as to define a downwardly facing recess; and an arm including an upright portion to which the back is mounted, wherein the arm further includes a forwardly extending lower portion;

wherein the arm lower portion is received within the recess and is pivotably mounted to the plate adjacent its forward end, for pivotably interconnecting the back with the seat.

8. The chair of claim 7, wherein the arm lower portion is pivotably mounted to the plate by means of a pair of pins extending transversely from the arm lower portion adjacent its forward end, wherein the pins are pivotably mounted to the plate one on either side of the recess.

9. The chair of claim 8, wherein the recess opens onto the rearward edge of the plate.

10. In a chair having a seat and a back, the improvement comprising:

a relatively thin profile plate to which the seat is mounted and having a downwardly facing recess toward its rearward end, the plate including a substantially central back mounting portion in which the downwardly facing recess is disposed, and a pair of side leg mounting portions located one on either side of the back mounting portion;

a pair of legs mounted to the plate located on opposite sides of the plate, each leg defining an upper mounting portion secured to one of the leg mounting portions of the plate; and an arm having an upright portion to which the back is mounted and further having a forwardly extending lower portion, wherein the arm lower portion is disposed within the plate recess and is pivotably mounted to the plate for pivotably interconnecting the back and the seat.

11. The chair of claim 10, wherein the plate defines a rearward edge, and wherein the recess includes a rearwardly extending portion which opens onto the rearward edge of the plate, and wherein the arm lower portion extends into the recess through the rearwardly extending portion of the recess.

12. The chair of claim 10, wherein the plate includes a lower wall defining the leg mounting portions, and a peripheral outer wall extending upwardly therefrom defining an upper edge engageable with a downwardly facing surface defined by the seat.

13. The chair of claim 12, wherein the plate includes an upper wall having a lower surface which in part defines the recess, and wherein the upper surface of the upper wall engages the underside of the seat.

* * * * *